US012740620B2

(12) United States Patent
Lee

(10) Patent No.: US 12,740,620 B2
(45) Date of Patent: Sep. 22, 2026

(54) ROPE ADJUSTING BUCKLE

(71) Applicant: Duraflex Hong Kong Limited, Hong Kong (CN)

(72) Inventor: Ray Lee, Taipei City (TW)

(73) Assignee: Duraflex Hong Kong Limited, Hong Kong (CN)

( * ) Notice: Subject to any disclaimer, the term of this patent is extended or adjusted under 35 U.S.C. 154(b) by 69 days.

(21) Appl. No.: 18/882,904

(22) Filed: Sep. 12, 2024

(65) Prior Publication Data

US 2025/0082071 A1 Mar. 13, 2025

(30) Foreign Application Priority Data

Sep. 13, 2023 (CN) ..... 202311181747.7
Sep. 13, 2023 (CN) ..... 202322484223.7

(51) Int. Cl.
*A44B 11/04* (2006.01)

(52) U.S. Cl.
CPC ..... *A44B 11/04* (2013.01)

(58) Field of Classification Search
CPC ..... A44B 11/04; F16G 11/12
See application file for complete search history.

(56) References Cited

U.S. PATENT DOCUMENTS 52,597 A * 2/1866 Plotts, I ..... A44B 11/04 24/200
4,608,735 A * 9/1986 Kasai ..... A44B 11/10 24/194
4,815,174 A * 3/1989 Sou ..... A44B 11/04 24/171
5,243,741 A * 9/1993 Fudaki ..... A44B 11/04 24/200
5,245,731 A * 9/1993 Funathu ..... A44B 11/04 24/200
5,651,166 A * 7/1997 Lundstedt ..... A44B 11/04 24/200
5,771,544 A * 6/1998 Wier ..... A44B 11/10 24/171
8,002,805 B2 * 8/2011 Le Couedic ..... A61B 17/7068 606/248
9,433,259 B2 * 9/2016 Jacobsen ..... A42B 3/066
10,856,626 B2 * 12/2020 Evans ..... A44B 11/006
2012/0297581 A1 * 11/2012 Pitman ..... A41F 15/002 24/200
2014/0018807 A1 * 1/2014 Foerster ..... A61B 17/08 606/74

* cited by examiner

*Primary Examiner* — David M Upchurch
(74) *Attorney, Agent, or Firm* — Collard & Roe, P.C.

(57) ABSTRACT

A rope adjusting buckle includes two supporting ribs arranged opposite to each other, and a connecting rib connected between the two supporting ribs. A rope can be wound on the connecting rib. The rope adjusting buckle also includes an abutting plate connected between the two supporting ribs; a channel for the rope to pass through is defined by the two supporting ribs and the abutting plate; and a plurality of rib parts are formed on the inner wall of the channel in a staggered manner.

5 Claims, 2 Drawing Sheets

ROPE ADJUSTING BUCKLE

CROSS REFERENCE TO RELATED APPLICATIONS

Applicant claims priority under 35 U.S.C. § 119 of Chinese Application No. 202311181747.7 filed Sep. 13, 2023 and Chinese Utility Model No. 202322484223.7 filed Sep. 13, 2023, the disclosures of which are incorporated by reference.

BACKGROUND OF THE INVENTION

1. Field of the Invention

The present invention relates to the field of buckles, in particular to a rope adjusting buckle.

2. The Prior Art

In existing rope adjusting buckles, a relatively narrow channel is usually provided therein, through which a rope can pass, and the rope is clamped by the friction force of wall surfaces on both sides of the channel so as to prevent the rope from slipping.

However, when the surface of the rope is relatively smooth or the diameter of the rope is relatively large (i.e., the compressible deformation is relatively large), the existing rope adjusting buckles are often difficult to effectively achieve the anti-slip effect on the rope, and the rope is also prone to slowly slip off and become loose.

SUMMARY OF THE INVENTION

The purpose of the present invention is to provide a rope adjusting buckle in view of the above technical problems.

The technical solution of the present invention to solve the technical problem is as follows:

The present invention provides a rope adjusting buckle, including two supporting ribs arranged opposite to each other, and a connecting rib connected between the two supporting ribs, where a rope can be wound on the connecting rib;

the rope adjusting buckle further includes an abutting plate connected between the two supporting ribs; a channel for the rope to pass through is defined by the two supporting ribs and the abutting plate; and a plurality of rib parts are formed on the inner wall of the channel in a staggered manner.

According to the rope adjusting buckle provided by the present invention, each of the supporting ribs includes a Z-shaped rib body and a flat plate portion formed by extending on the Z-shaped rib body.

The flat plate portions of the two supporting ribs are arranged opposite to each other; the connecting rib is connected between the flat plate portions of the two supporting ribs; the abutting plate is also connected between the flat plate portions of the two supporting ribs.

The plurality of rib parts are divided into two groups, where one group of rib parts are formed on the flat plate portion of one supporting rib, and the other group of rib parts are formed on the flat plate portion of the other supporting rib.

The two groups of rib parts are arranged in a staggered manner.

According to the rope adjusting buckle provided by the present invention, the rope adjusting buckle further includes a connecting rod connected between the Z-shaped rib bodies of the two supporting ribs, where a flexible strip can be wound on the connecting rod.

According to the rope adjusting buckle provided by the present invention, the rope adjusting buckle further includes a pressing connecting member connected between the Z-shaped rib bodies of the two supporting ribs for pressing the flexible strip.

According to the rope adjusting buckle provided by the present invention, the rib parts are tooth-shaped, and the two groups of rib parts are engaged with each other.

According to the rope adjusting buckle provided by the present invention, the plurality of rib parts are formed on the inner wall of the existing channel in a staggered manner, so that the rope extending into the channel is repeatedly bent, and the rope is prevented from slipping under the friction of the plurality of rib parts. The rope adjusting buckle provided by the present invention is novel in design and high in practicability.

BRIEF DESCRIPTION OF THE DRAWINGS

The present invention will be further described below with reference to the accompanying drawings and embodiments. In figures.

DETAILED DESCRIPTION OF THE EMBODIMENTS

The technical problem to be solved by the present invention is that: for the existing rope adjusting buckles, when the surface of a rope is relatively smooth or the diameter of the rope is relatively large (i.e., the compressible deformation is relatively large), the existing rope adjusting buckles are often difficult to effectively achieve the anti-slip effect on the rope, and the rope is also prone to slowly slip off and become loose. The technical idea proposed by the present invention to solve the technical problem is: a plurality of rib parts are formed on the inner wall of the existing channel in a staggered manner, so that a rope extending into the channel is repeatedly bent, and the rope is prevented from slipping under the friction of the plurality of rib parts.

In order to make the technical purpose, technical solutions and technical effect of the present invention clearer and thus to facilitate those skilled in the art to understand and implement the present invention, the present invention will be further described in detail below with reference to the accompanying drawings and specific embodiments.

Figure 1:
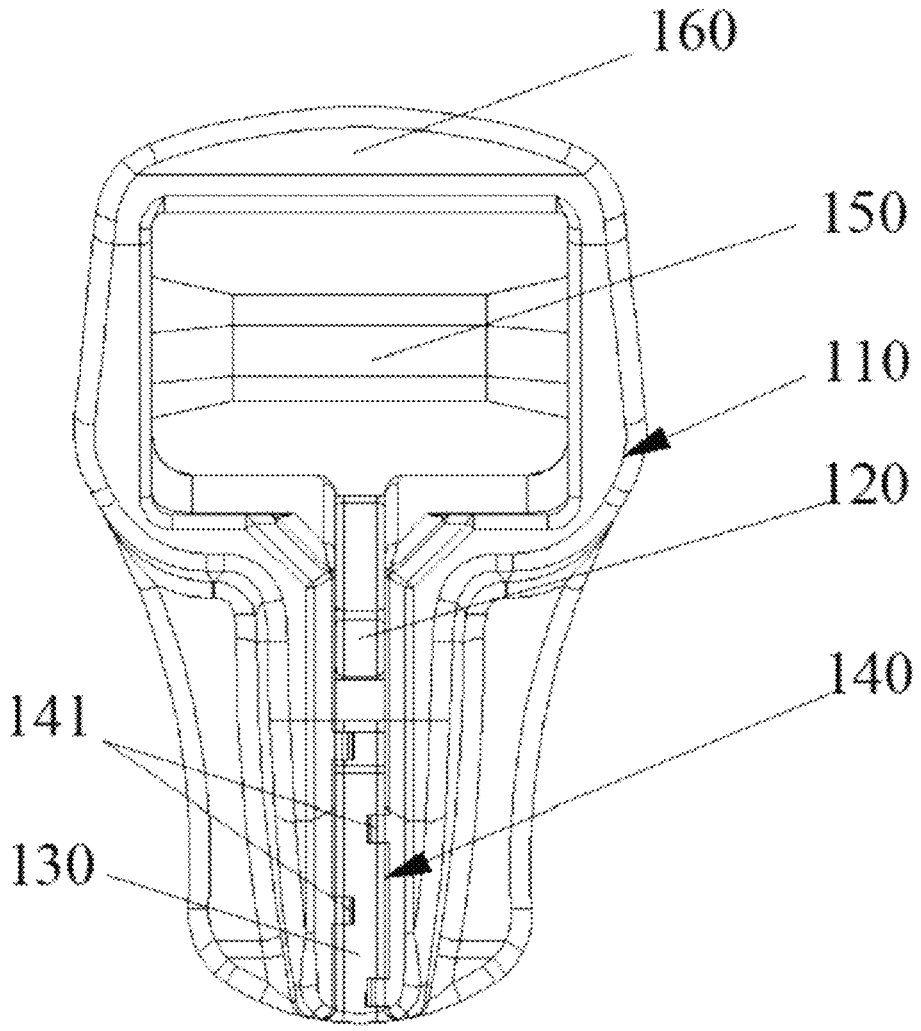
FIG. 1 shows a schematic diagram of the structure of a rope adjusting buckle provided by a preferred embodiment of the present invention.
Figure 2:
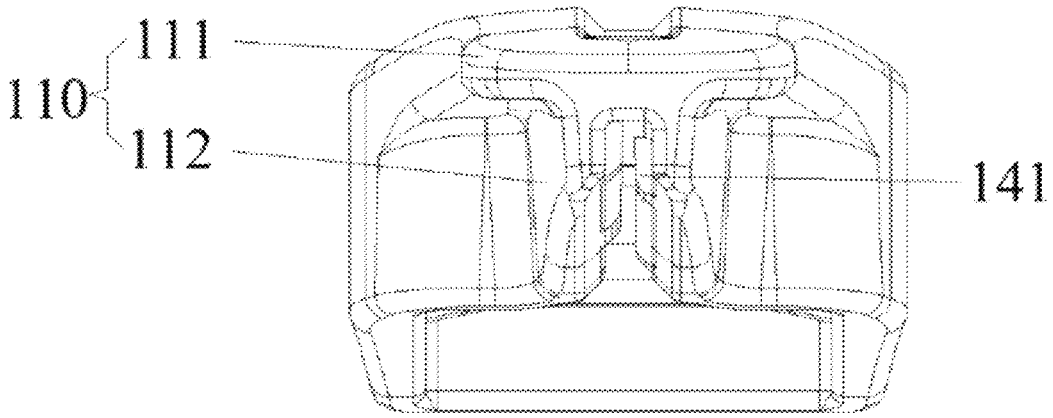
FIG. 2 shows a schematic diagram of the structure of the rope adjusting buckle shown in FIG. 1 in another direction.
Figure 3:
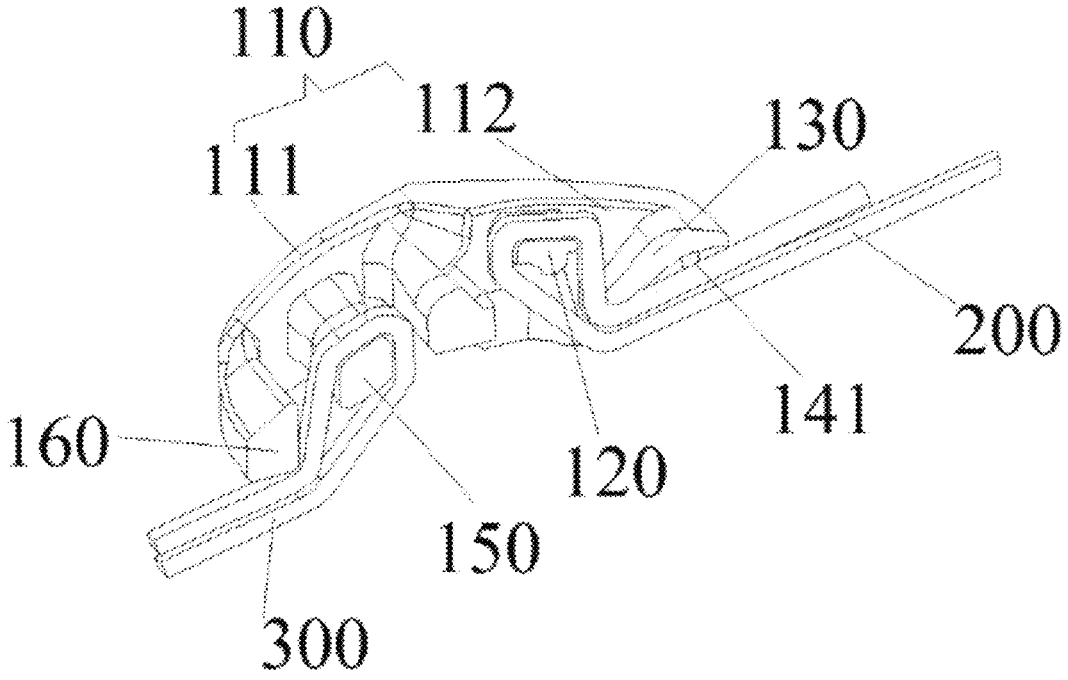
FIG. 3 shows a schematic diagram of the structure of the rope adjusting buckle shown in FIG. 1 in yet another direction.

As shown in FIG. 1 to FIG. 3, FIG. 1 shows a schematic diagram of the structure of a rope adjusting buckle provided by a preferred embodiment of the present invention; FIG. 2 shows a schematic diagram of the structure of the rope adjusting buckle shown in FIG. 1 in another direction; and FIG. 3 shows a schematic diagram of the structure of the rope adjusting buckle shown in FIG. 1 in yet another direction. Specifically, the rope adjusting buckle includes two supporting ribs 110 arranged opposite to each other, and a connecting rib 120 connected between the two supporting ribs 110, where a rope 200 can be wound on the connecting rib.

The rope adjusting buckle further includes an abutting plate 130 connected between the two supporting ribs 110; a channel 140 for the rope 200 to pass through is defined by the two supporting ribs 110 and the abutting plate 130.

A plurality of rib parts 141 are formed on the inner wall of the channel 140 in a staggered manner.

The above technical solution is a basic solution, in which the plurality of rib parts 141 are formed on the inner wall of the channel 140 in a staggered manner, so that the rope 200 extending into the channel 140 is repeatedly bent, and the rope is prevented from slipping under the friction of the plurality of rib parts 141.

Further, in this embodiment, each of the supporting ribs 110 includes a Z-shaped rib body 111 and a flat plate portion 112 formed by extending on the Z-shaped rib body 111.

The flat plate portions 112 of the two supporting ribs 110 are arranged opposite to each other; the connecting rib 120 is connected between the flat plate portions 112 of the two supporting ribs 110; the abutting plate 130 is also connected between the flat plate portions 112 of the two supporting ribs 110.

The plurality of rib parts 141 are divided into two groups, where one group of rib parts 141 are formed on the flat plate portion 112 of one supporting rib 110, and the other group of rib parts 141 are formed on the flat plate portion 112 of the other supporting rib 110.

The two groups of rib parts 141 are arranged in a staggered manner.

The staggered arrangement and mutual cooperation of the two groups of rib parts 141 can make the channel 140 bend repeatedly more regularly, thereby increasing the anti-slip friction force on the rope. Specifically, in this embodiment, the rib parts 141 are tooth-shaped, and the two groups of rib parts 141 are engaged with each other.

Further, the rope adjusting buckle further includes a connecting rod 150 connected between the Z-shaped rib bodies 111 of the two supporting ribs 110, where a flexible strip 300 can be wound on the connecting rod. In this way, the rope adjusting buckle achieves the technical effect of connecting the rope 200 and the flexible strip 300 together through the connecting rod 150 and the connecting rib 120. The flexible strip 300 may be a belt or woven tape, or even a rope.

Further, as shown in FIG. 3, the rope adjusting buckle further includes a pressing connecting member 160 connected between the Z-shaped rib bodies 111 of the two supporting ribs 110 for pressing the flexible strip 300. Here, a belt buckle is defined by the Z-shaped rib bodies 111 of the two supporting ribs 110, the pressing connecting member 160, and the connecting rod 150. When the flexible strip 300 is straightened, the pressing connecting member 160 makes the flexible strip 300 bend by pressing the flexible strip 300, which increases the anti-sliding friction force to the flexible strip 300.

As shown in FIG. 3, when in use, one end of the rope 200 extends into the channel 140, is then wound around the connecting rib 120, and then passes back through the channel 140; at the same time, one end of the flexible strip 300 passes through the part between the pressing connecting member 160 and the connecting rod 150, is then wound around the connecting rod 150, and then passes back. In this way, the technical effect of connecting the rope 200 and the flexible strip 300 together is achieved through the rope adjusting buckle. When the rope 200 extends into the channel 140, the two groups of rib parts 141 on the inner wall of the channel 140 are arranged in a staggered manner and cooperate with each other to repeatedly bend the rope 200 for a plurality of times, thereby achieving an anti-slip effect on the rope 200.

It should be understood that, for those of ordinary skill in the art, improvements or variations can be made according to the above description, and all these improvements and variations shall fall within the protection scope as defined in the appended claims of the present invention.

What is claimed is:

1. A rope adjusting buckle, comprising two supporting ribs (110) arranged opposite to each other and extending in a longitudinal direction, the supporting ribs each having inner surfaces that face each other, and a connecting rib (120) connected between the two supporting ribs (110), wherein a rope (200) can be wound on the connecting rib;

the rope adjusting buckle further comprising an abutting plate (130) connected between the two supporting ribs (110); a channel (140) for the rope (200) to pass through being defined by the inner surfaces of the two supporting ribs (110) and the abutting plate (130), the channel extending in the longitudinal direction; and a plurality of rib parts (141) being formed on the inner wall of the channel (140) on the inner surfaces of the two supporting ribs, the plurality of rib parts on one of the supporting ribs being arranged in a staggered manner with respect to the plurality of rib parts on the facing supporting rib.

2. The rope adjusting buckle according to claim 1, wherein each of the supporting ribs (110) comprises a Z-shaped rib body (111) and a flat plate portion (112) formed by extending on the Z-shaped rib body (111);

the flat plate portions (112) of the two supporting ribs (110) are arranged opposite to each other; the connecting rib (120) is connected between the flat plate portions (112) of the two supporting ribs (110); the abutting plate (130) is also connected between the flat plate portions (112) of the two supporting ribs (110);

the plurality of rib parts (141) are divided into two groups, wherein one group of rib parts (141) are formed on the flat plate portion (112) of one supporting rib (110), and the other group of rib parts (141) are formed flat plate portion (112) of the other supporting rib (110); and the two groups of rib parts (141) are arranged in a staggered manner.

3. The rope adjusting buckle according to claim 2, wherein the rope adjusting buckle further comprises a connecting rod (150) connected between the Z-shaped rib bodies (111) of the two supporting ribs (110), wherein a flexible strip (300) can be wound on the connecting rod.

4. The rope adjusting buckle according to claim 3, wherein the rope adjusting buckle further comprises a pressing connecting member (160) connected between the Z-shaped rib bodies (111) of the two supporting ribs (110) for pressing the flexible strip (300).

5. The rope adjusting buckle according to claim 2, wherein the rib parts (141) are tooth-shaped, and the two groups of rib parts (141) cooperate with each other to form alternating bends in the channel.

* * * * *